United States Patent [19]

Schneider

[11] Patent Number: 4,512,842

[45] Date of Patent: Apr. 23, 1985

[54] LABELING MACHINE

[75] Inventor: Egon Schneider, Neutraubling, Fed. Rep. of Germany

[73] Assignee: Krones AG Herman Kronseder Maschinenfabrik, Neutraubling, Fed. Rep. of Germany

[21] Appl. No.: 574,525

[22] Filed: Jan. 27, 1984

[30] Foreign Application Priority Data

Feb. 8, 1983 [DE] Fed. Rep. of Germany ..... 3304191

[51] Int. Cl.[3] ..... B65C 9/16; B65C 9/42

[52] U.S. Cl. ..... 156/357; 156/364; 156/568; 156/571

[58] Field of Search ..... 156/356, 357, 566, 568, 156/571, 364

[56] References Cited

U.S. PATENT DOCUMENTS

| | | | |
|---|---|---|---|
| 2,936,921 | 5/1960 | Schulz | 156/357 X |
| 4,172,753 | 10/1979 | Benoit | 156/357 |
| 4,242,167 | 12/1980 | Hoffmann | 156/357 |
| 4,354,887 | 10/1982 | Total | 156/357 X |
| 4,361,460 | 11/1982 | Kronseder | 156/568 |
| 4,445,961 | 5/1984 | Kronseder | 156/568 X |

*Primary Examiner*—David Simmons

*Attorney, Agent, or Firm*—Fuller, House & Hohenfeldt

[57] ABSTRACT

A bottle labeling machine has a rotor on which oscillatingly driven members are arranged in a circular pattern around the rotor axis. A pallet shaft is coupled to each member for being oscillated and for tilting on the member. A portion of each shaft remote from the tilt axis is engaged in a universally movable bearing on a support that is slideable radially inwardly and outwardly relative to the rotor axis. There is a curved glue pallet on each shaft for rolling on a glue roller and a label in sequence as the shafts revolve in a circular path. The slideable support is actuated by a pneumatic piston which is controlled by a valve which is, in turn, controlled by a sensor for sensing whether a bottle will be present at an application station to receive a label. If there will be no bottle there, the piston is actuated and the pallet shaft is tilted to prevent the pallet from contacting the roller and label but oscillation of the shaft is not interrupted.

6 Claims, 4 Drawing Figures

Fig. 2
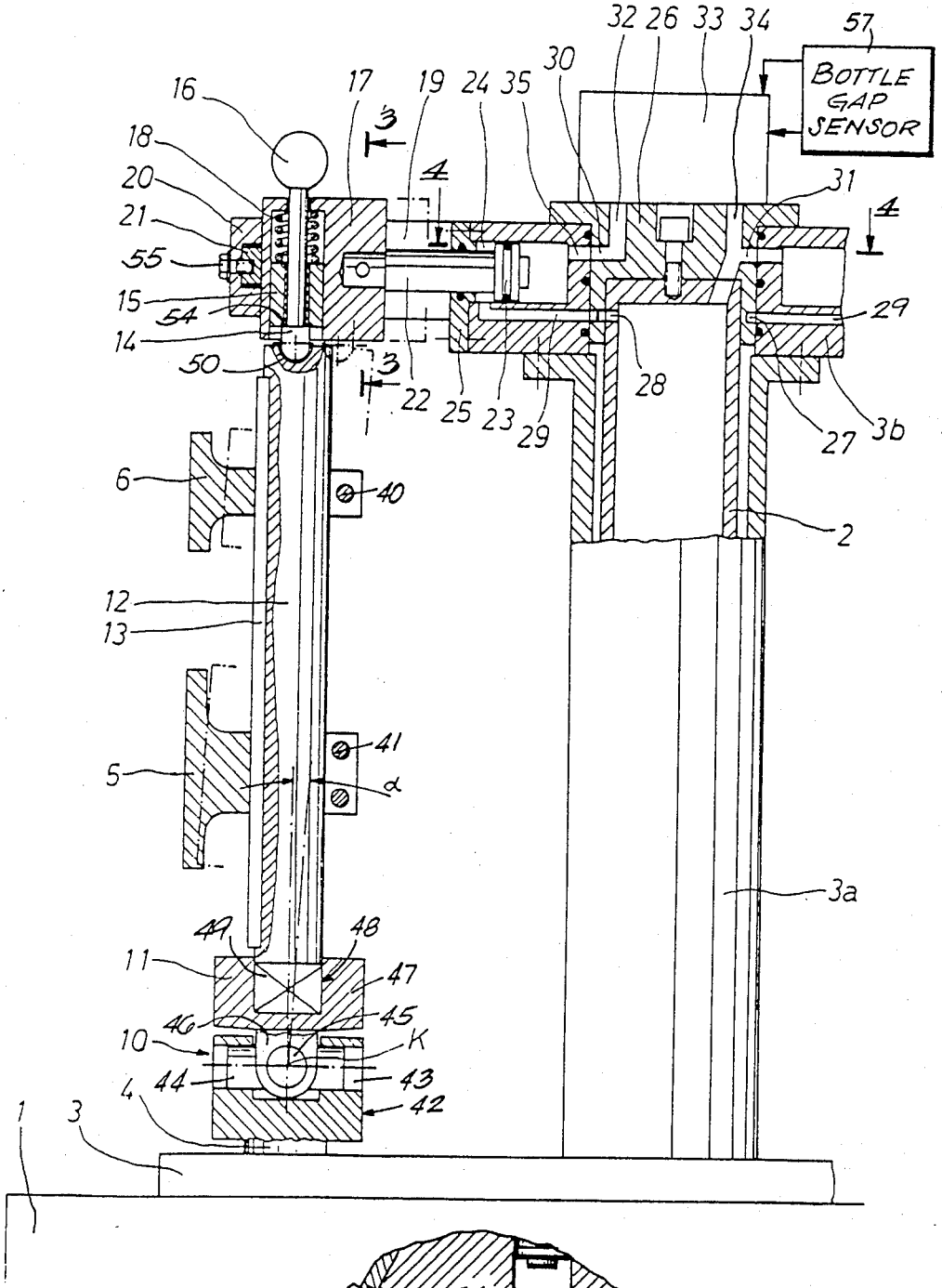
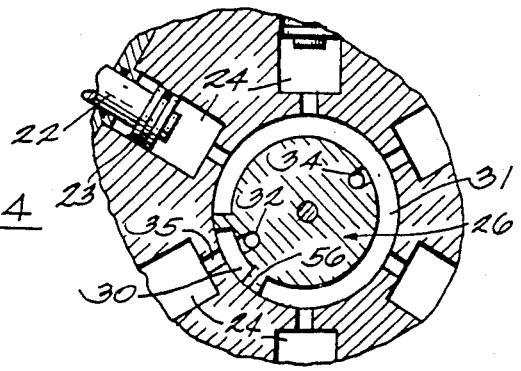
Fig. 4

LABELING MACHINE

BACKGROUND OF THE INVENTION

This invention relates to a machine for applying labels to containers such as bottles as they are conveyed past a label application station.

In a known type of labeling machine a disk or rotor is rotated about a vertical axis at a constant speed. The rotor has several pallet shafts arranged in a circle around its axis. Each shaft has a glue pallet and the pallets have surfaces for receiving a coating of glue which surfaces are segments of a circle. A mechanism is provided for oscillating the shafts about their vertical axes so that each pallet can engage a glue applicator roller in a rocking or rolling fashion and then continue in a circular path to a label stack where a label becomes adhered to the pallet. After rolling over a glue label and picking it up, the pallet continues in its circular path to a transfer drum which picks the label off of the pallet and carries it around to the station where it is pressed on the bottle that has been conveyed to the station at the moment. When there is a gap in the line of bottles being conveyed toward the label application station, it is necessary to interrupt the label pick up and transfer operations lest the machine become fouled with labels. Accordingly, means are provided to detect that a gap of one or more bottles will occur at the application station. In prior art apparatus, air pressure actuated couplings or clutches are used to operate a mechanism that restrains the pallet shaft against oscillation at an angle wherein the glue surface segment of the pallet is held away from the glue roller and label stack. After the pallet has at least passed the label stack, the oscillating motion of the pallet shaft is restored but is again interrupted if, by the time the pallet gets to a predetermined position in its orbit, there is no bottle at the label application station. Prior art mechanisms for deactivating and reactivating pallets have been structurally complicated and composed of heavy parts since they must stop pallet oscillation abruptly and restore it abruptly. The operating parts of the mechanism must move through a substantial distance at high speed so they are inclined to wear to the point where they require replacement or maintenance in a less than desirable amount of time. Moreover, prior labeling machines have the disadvantage of requiring coupling or uncoupling of the pallet shafts at a single point or within a very small angular range in the orbital path of the pallets.

SUMMARY OF THE INVENTION

One object of the present invention is to provide a labeling machine that provides for retracting and advancing the pallets out of and into contact with the glue applicator and label stack at any desired place in the circular path of the pallets without interrupting oscillation of the pallets.

Another object is to provide a mechanism for inactivating the pallets, that is, holding them out of contact with the glue roller and label stack which mechanism requires very small movement of its operating parts such that its operating speed can be high and its wear low.

In accordance with the invention, the pallet shafts and, hence, the pallets are allowed to continue oscillating even when the shafts are actuated to hold the pallets out of contact with the glue applicator roller and the label stack. Thus, there is no abrupt starting and stopping of the pallets. This is accomplished by supporting the shafts so they are tiltable about a pivot axis near their lower ends. The pallets are axially displaced from the pivot axis so the shaft has to be tilted only through a small angle to provide sufficient clearance between the pallets and the glue applicator roller, the label stack and the gripper or label transfer cylinder. In accordance with the invention, the pallet shafts can continue to oscillate in their tilted or inactive position so there is no abrupt stopping or starting of the oscillating motion of the pallets. Thus, it is possible to inactivate or put the pallets in their neutral position in their circular path between the glue roller and stack of labels and put them in active position in the part of the path between the gripper or transfer cylinder and the glue roller. Since driving of the pallet shafts oscillatingly is never interrupted, there can never be a loss of synchronism or phasing between the pallets, the glue roller, the label stack or the transfer cylinder.

A further feature of the invention is that each of the pallet units is provided with an adjustable stop that assures having the pallet shaft be perfectly vertical when it is in active position so that the one or more axially spaced apart glue pallets on the shaft interface accurately over their entire curved surface area with the glue roller and the label stack as the pallets roll over or rock on these elements.

How the foregoing and other objects and features of the invention are achieved will be evident in the more detailed description of a preferred embodiment of the new labeling machine which will now be set forth in reference to the drawings.

DESCRIPTION OF THE DRAWINGS

FIG. 2 is a section taken on the line corresponding with 2—2 in FIG. 1;

FIG. 4 is a transverse section taken on a line corresponding with 4—4 in FIG. 2.

DESCRIPTION OF A PREFERRED EMBODIMENT

Figure 1:
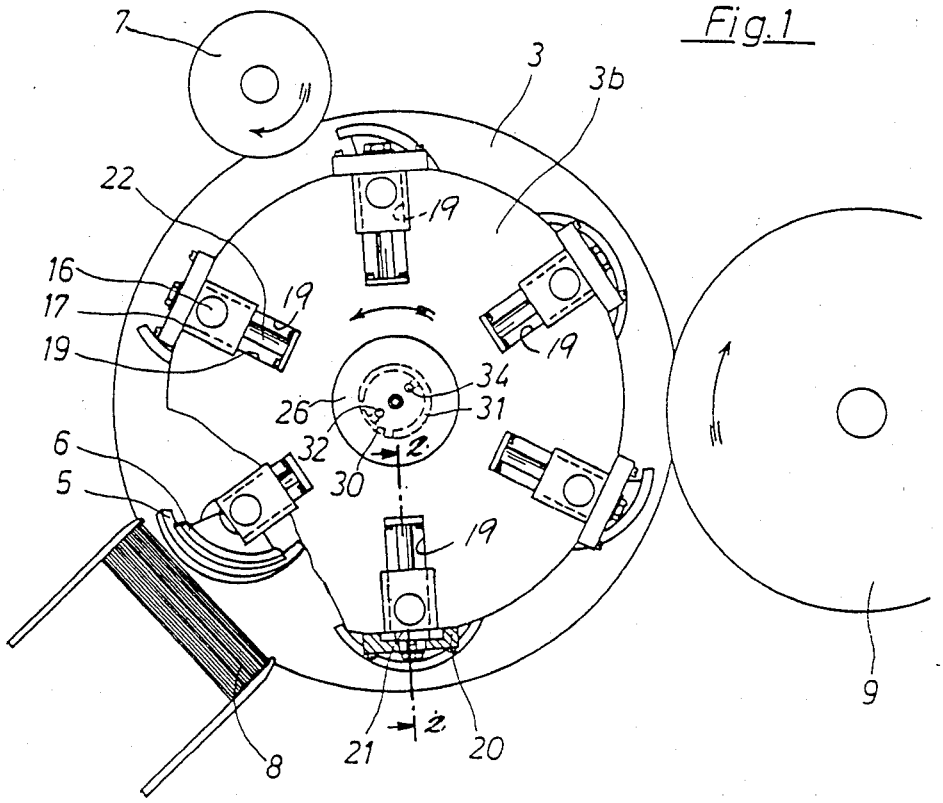
FIG. 1 is a plan view of the new labeling machine.

Referring to FIGS. 1 and 2, the new labeling machine comprises a stationary housing 1 from which a stationary pressurized air conducting pipe or tubular member 2 extends. A hollow shaft 3*a* is concentric to pipe 2 and a drum-shaped rotor member 3 supports shaft 3*a*. Hollow shaft 3*a* supports an upper rotor plate 3*b*. There are, in the illustrated embodiment, 6 oscillating drive shafts 4 extending from rotor 3. The oscillating motion of shafts 4 is imparted with a cam gear, not shown, which is located within housing 1. The pallet shafts are marked 12 as can be seen in FIG. 2. Glue pallets 5 and 6 are clamped on shaft 12 and secured against rotation on the shaft by means of a straight key 13. The bolts 40 and 41 for clamping pallets 5 and 6 to their oscillating shafts 12 are marked 40 and 41 in FIG. 2. As can be seen in FIG. 1, the pallets have outer surfaces that are curved and constitute segments of a circle. In FIG. 1, the pallets of one oscillating assembly are presently aligned with a stack of labels 8. When the pallets have been previously coated by rocking on a glue applicator roller 7, they advance in their circular path to the label stack and roll on it to thereby pick up a label and carry it around to a transfer cylinder 9 which is provided with conventional fingers, not shown, which pick the labels off of the pallets and carry them around on the transfer cylinder 9 to a station through which a series of bottles, not shown, is conveyed for being labeled. As can be seen in FIG. 1, the pallets 5 and 6 are oscillated to various angular positions in the course of their circular path within the confines of glue roller 7, label stack 8 and transfer cylinder 9.

Attention is again invited to the oscillatingly driven shafts 4 in FIG. 2. Each shaft 4 is provided with a block member 42 in which there is a cross bore 43. There is a pin 44 in bore 43. Another pin 45 passes through pin 44 and pin 45 carries a clevis 46. Pin 44 can rotate slightly about its axis in bore 43 and pin 45 can rotate about its axis perpendicularly to the axis of pin 44. The two pins constitute a universal joint so shaft 12 can be tilted about an axis marked K. Link 46 is fastened to a socket block 47 in which there is a square recess or socket 48. The lower end 49 of shaft 12 is shaped complementarily to socket 48 to thereby produce a driving connection between the oscillating socket member 47 and shaft 12. The arrangement makes the shaft 12 easily insertable in socket 48 and easily removable therefrom.

In the illustrated embodiment, there are two glue pallets 5 and 6 in which case there must be two stacks of labels 8 at the levels of the pallets so that each pallet can pick up a separate label. The lower pallet picks up the so called core or trunk labels and the upper picks up the so called breast labels which are intended for application to beverage bottles. 'Bottles' is used herein as generic to containers of various types.

Referring particularly to FIG. 2, the upper end of each pallet shaft 12 is provided with a semispherical recess 50 that is concentric to the rotational axis of the shaft. A bolt 14 having a rounded or semispherical lower end is nested in complementarily shaped recess 50. There is a shoulder 54 on the lower end of bolt 14. This shoulder reacts against a bushing 15. Bushing 15 is in a bore in a block 17. A spring 18 reacts against bushing 15 and, because of shoulder 54, forces bolt 14 into firm contact with semispherical recess 50 in shaft 12. It will be evident that if the knob 16 on bolt 14 is grasped and pulled away from the block 17 in opposition to the force of spring 18, the hemispherical lower end of bolt 14 will disengage from the corresponding recess 50 in shaft 12 so that the shaft may be easily removed. But the primary purpose for having the semispherical surface on bolt 14 registered in corresponding recess 50 is to provide a bearing that permits the shaft 12 to tilt and oscillate when block 17 is translated to the position where it is represented by phantom dash-dot lines in FIG. 2. The shaft is actually tilted about the pivot axis of K or the axis of pin 45. As is evident in FIG. 2, when the shaft is tilted inwardly toward the rotational axis of the rotor, pallets 5 and 6 become retracted radially inwardly to what is called neutral position so that they cannot contact the glue roller 7 nor with the foremost label in label stack 8.

Figure 3:
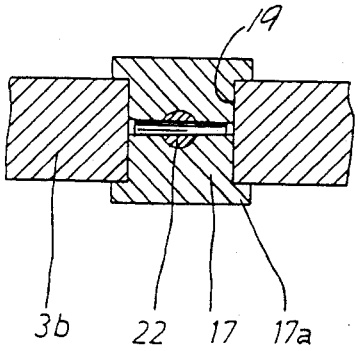
FIG. 3 is a section taken on a line corresponding with 2—2 in FIG. 2.

As shown in FIG. 2, the circular upper plate **3*b* of the rotor has a radially extending slot 19 associated with each of the pallet assemblies. Each block 17 is slideable in a radial slot 19 to cause tilting of the oscillating shafts 12. As shown in FIG. 3, the blocks 17 are provided with shoulders 17*a* which overhang the radial slots 19 and bear on rotor plate 3*b* so that the blocks 17 are guided in a perfectly straight radial line and are prevented from shifting up or down. The radially outward open end of each slot 19 is closed by means of a stop plate 20 which, as can be seen in FIG. 1, is bolted to rotor plate 3*b*. As can be seen more easily in FIG. 2, there is a stop member 21 in stop plate 20. The stop member is slideable along an inclined plane, which is not readily visible. There is a bolt 55 extending through a long slot in the outer surface of stop plate 20 and this bolt is engaged with the slideable member 21. Thus, the slideable member can be adjusted to a position where it brings about stopping block 17 at a place where oscillating shaft 12 is vertical or, in any event, where the curved surfaces of pallets 5 and 6 will interface uniformly with the glue rollers and label stacks. After this adjustment is made, bolt 55 is tightened and shafts 12** remain fixed in the desired most radially outwardly position with respect to the rotational axis of the rotor.

On the radially inward side of block 17 it is connected by means of a pin to a piston rod 22 which connects to one side of a differential piston 23. The piston is in a pneumatic cylinder 24 which is formed in rotor cover plate **3*b*. The cylinder 24 is closed at one end by means of a cover 25. The axis of the cylinder 24 is coincident with a radius extending from the axis of rotation of rotor 3. There is an o-ring seal in cover plate 25 through which piston rod 22 slides without leakage. In FIG. 2 the left side of piston 23 to which the piston rod 22 is connected has a lesser effective pressure area than the right side. The small extension on the right side of piston 23 can strike the bottom of the cylinder to thereby set the maximum distance to which the shaft 12 may be tilted in order to have its pallets 5 and 6 clear the glue roller and label stack. The angle of tilt is indicated by the letter alpha. When the shaft 12 is tilted radially inward about pivot axis K, the shaft and its pallets are said to be in neutral position or in inactive position since the pallets cannot roll or rock on the glue roller nor the labels. The shaft is shown in solid lines as being presently in its active position in FIG. 2 in which case piston 23 is at the limit of its leftward movement as determined by stop block 21. In an actual embodiment, a tilting angle shaft 12 in the amount of 4° has been found sufficient for withdrawing the lower glue pallet 5 for the trunk or core labels sufficiently far radially inward for the pallets to clear the labels and glue roller. As indicated earlier, and as is evident from the structural description thus far, shafts 12 can continue to be oscillated and are oscillated when the pallet shafts 12 are tilted. Piston 23 not only drives member 17** between the limits of its active position and neutral position, but it also holds the member and, hence, the shaft positively in either active or neutral position by reason of air pressure always being applied to one side of the piston or the other while the pallet shafts are following their orbital path.

The hollow stationary shaft or pipe 2 is supplied with pressurized air from a source, not shown, that connects to the lower end of hollow shaft 2 within housing 1. A stationary control disk 26 is fastened to the upper end of hollow shaft 2. Upper rotor plate **3*b* is provided with a bore for accommodating the shank of control disk 26 and there are o-ring seals interposed between the cylindrical shank of the control disk and the rotor cover plate 3*b*. As can be seen from FIG. 2, the periphery of the cylindrical part of control disk 26 is provided with an annular groove 27 which communicates by way of a port 28 with the pressurized air in hollow shaft 22. Thus, a full circular groove 27 always contains air under pressure. Radially extending channels 29 in the top of rotor plate 3*b* lead to the radial outward side of the differential piston 23 in chamber 24. The smaller piston area, the left side of the piston 23 in FIG. 2 is always acted upon by compressed air during the entire revolution or orbit of the rotor 3 and this pressure attempts to force piston 23** radially inward to its end position.

There are two more grooves 30 and 31 of different circumferential lengths above full annular groove 27 in control disk 26. These grooves are shown in FIG. 1 and particularly clearly in FIG. 4 which is a transverse section taken on a line corresponding with 4—4 in FIG. 2. Grooves 30 and 31 lie in the same plane and are separated from each other by ribs such as 56 in FIG. 4. Groove 30 is arranged in the angle of revolution through which the pallet shafts 12 pass shortly before, through or during, and shortly after removal of labels from the stack of labels 8. The longer groove covers the remaining angle of revolution. Short groove 30 is connected with a control valve 33 by means of a bore 32. The control valve is fixed to the upper side of stationary control disk 26 and the longer groove 31 is connected directly with the pressurized interior of the hollow stationary pipe or shaft 2 by means of a bore 34. The bore 34 also supplies compressed air to control valve 33. The control valve is electrically actuated and responds to operating power received from a bottle gap sensor which is symbolized by the block marked 57 in FIG. 2. This sensor detects a gap or the absence of one or more bottles in the bottle feed line and detects the presence of bottles and provides corresponding operating power to electrically operated control valve 33. When the control valve is in one state, it feeds pressurized air to short groove 30 and when it is in another state, it evacuates short groove 30. There are channels 35 formed in rotor cover plate 3*b* and, as they rotate, these channels connect either groove 30 or 31 to cylinder chamber 24 on the large area sides of the differential pistons 23. When the large angle groove 31 is aligned with the channels 35 in cover plate 3*b* the large surface area of the differential piston is pressurized to thereby force the piston radially outwardly which puts the oscillating and tiltable pallet shaft 12 in its untilted attitude so that the pallets 5 and 6 on the shaft 12 can contact and roll on the glue roller 7 and labels 8. There is pressure applied to the small area side of differential piston 3 at this time through channels 29 but the greater total force is developed on the large area side of differential piston 23 so the block 17 and, hence, shaft 12 are driven radially outwardly. Since it is assumed at the moment that no gap in the series of bottles has been detected, the piston will derive pressure from the valve through bore 32 and channel 35 so that block 17 and pallet shaft 12 will be constantly pushed radially outwardly with a high force over the length of circumferentially longer groove 31. Even when the channel 35 lines up with the short groove 30 and this group is pressurized by control valve 33, the piston 23 and, hence, the pallet shafts 12 remain forced radially outwardly where the pallets can contact the glue roller and labels. On the other hand, when the control valve 33 receives a signal from the bottle gap sensor 57 indicative of a bottle being absent from the label transfer station, then when the channel 35 becomes aligned with a short groove 30 the control valve evacuates or exhausts air from the short groove 30 for as long as channel 35 is aligned with the short groove. Then, since there is pressure on the small area side of differential piston 23, derived from hollow shaft 2 by way of annular groove 27 and channel 29, the piston is pressed radially inwardly by means of the now preponderant force on its small area side as compared with its exhausted large area side. This shifting of the piston inclines the pallet shaft to its neutral position so it passes the stack of labels and glue roller although the shaft is still oscillating. As soon as channel 35 encounters the longer groove 31 again, the pallet shaft by action of piston 33 is shifted back again to its active or untilted operating position.

I claim:

1. A labeling machine wherein at least one glue pallet is moved in a circular path contiguous with a glue applicator, a label stack and a device for removing glue coated labels from the pallets for the labels to be applied to bottles conveyed through an application station, said machine comprising:

rotationally driven rotor means, at least one oscillatingly driven member on said rotor means radially spaced from the rotor axis, a pallet supporting shaft and a glue pallet mounted to the shaft, said shaft being coupled near one end to said driven member for being oscillated and for tilting between an active position most remote from said rotor axis and a neutral position closer to said axis, movable support means mounted to said rotor means and bearing means on said support means supporting said shaft for oscillating, means for sensing a gap in the series of bottles conveyed through said label application station, and actuating means responding to a gap being sensed by moving said movable support means closer to said rotor axis to thereby tilt the continuously oscillating shaft to neutral position so the pallet on said shaft cannot contact said glue applicator or a label in said stack as it continues in the circular path.

2. The labeling machine according to claim 1 wherein said movable support means for supporting said upper end of a pallet shaft comprises a member mounted for sliding radially inwardly and outwardly relative to the rotational axis of said rotor, stop means fixed on said rotor in the path of said member for positively stopping radial outward movement of said member and the pallet shaft supported thereby, and means for adjusting the position of said stop means to thereby establish said shaft in an attitude at which said pallet will make accurate contact with said glue applicator and label when said shaft is in active position.

3. The labeling machine according to claim 1 wherein:

said movable support means for supporting said upper end of a pallet shaft comprises a member and guide means on said rotor for guiding the movement of said member radially inwardly and outwardly relative to the axis of said rotor under the influence of said actuating means, said upper end of said pallet shaft having a rounded recess therein, bolt means mounted slideably in said member in the direction of said recess said bolt means having a rounded end portion registrable in said recess to form with said recess a bearing that enables said pallet shaft to rotate and tilt, and spring means acting on said bolt means to press said rounded end into said recess.

4. The labeling machine according to any of claims 2 or 3 wherein:

said actuating means for each pallet shaft comprises a pneumatic cylinder on said rotor, a differential piston in each cylinder, and a piston rod coupling the side of said piston having the smaller effective area to said pallet shaft supporting means, first and second air passageways communicating with said cylinder, respectively, on the larger and smaller area sides of said piston, means for sensing if a bottle will or will not be present at said station to receive a label, valve means having an inlet port for being supplied with pressurized air and having a common outlet and exhaust port, said valve means being controlled by said sensing means to pressurize said outlet port when a bottle will be present to thereby pressurize said first passageway and the larger area side of said piston to drive said pallet shaft to its active position and to exhaust said common port on said larger area side when a bottle will not be present, said second air passageway to said cylinder being in continuous communication with a source of pressurized air that acts on the small area side of the piston in opposition to the greater force on the large area side such that when said large area side is exhausted in the absence of a bottle, said piston will move and effect inward tilting of the pallet shaft.

5. The labeling machine according to claim 4 including a stationary pipe member arranged coaxially to the rotor axis and supplied internally with compressed air, a control disk member fixed to said pipe and having a passageway for communicating said compressed air in the pipe to said valve inlet port, said disk member having an annular groove to which all of said second passageways to said smaller area sides of the pistons are connected and said pipe having a hole leading to said groove for supplying the groove with pressurized air, said disk member also having two coplanar circular grooves one of which extends over a substantially lesser angle than the other, each cylinder having a port situated in the plane of said grooves for rotating past the grooves as the rotor rotates, the lesser angle groove communicating with said common valve outlet and exhaust port and the greater angle groove communicating constantly with said pressurized air in said pipe, whereby if when said port in a cylinder is aligned with said shorter groove when said shorter groove is exhausted said piston will be forced in a direction to tilt said shaft to neutral position and as said port passes over said larger angle groove said piston will be forced in a direction to restore said shaft to active position for the major part of its orbit.

6. The labeling machine according to claim 5 including a hollow rotatably driven shaft on which said rotor rotates said shaft being concentric to the exterior of said stationary pipe.

* * * * *